United States Patent [19]

Rolfe

[11] Patent Number: 4,565,935

[45] Date of Patent: Jan. 21, 1986

[54] LOGARITHMIC CONVERTER CIRCUIT ARRANGEMENTS

[75] Inventor: Norman F. Rolfe, Carlisle, Mass.

[73] Assignee: Allied Corporation, Morristown, N.J.

[21] Appl. No.: 400,688

[22] Filed: Jul. 22, 1982

[51] Int. Cl.[4] ..... G06G 7/24

[52] U.S. Cl. ..... 307/491; 307/492; 328/145

[58] Field of Search ..... 307/491, 492; 328/144, 328/145, 30; 356/223; 330/306

[56] References Cited

U.S. PATENT DOCUMENTS

| | | | |
|---|---|---|---|
| 3,237,028 | 2/1966 | Gibbons | 307/88.5 |
| 3,492,497 | 1/1970 | Gilmour et al. | 307/229 |
| 3,506,847 | 4/1970 | Schow | 307/230 |
| 3,532,868 | 10/1970 | Embley | 235/194 |
| 3,683,205 | 8/1972 | Fowler et al. | 307/230 |
| 3,811,088 | 5/1974 | Hekimian | 324/132 |
| 3,967,105 | 6/1976 | Harrington | 235/197 |
| 4,004,141 | 1/1977 | Curtis | 235/194 |
| 4,065,682 | 12/1977 | Evans | 307/261 |
| 4,091,329 | 5/1978 | Fletcher et al. | 328/145 |
| 4,097,767 | 6/1978 | Blackmer et al. | 307/229 |
| 4,232,233 | 11/1980 | Clouser et al. | 307/229 |
| 4,315,209 | 2/1982 | Schmoock | 323/313 |
| 4,434,380 | 2/1984 | Welland | 328/145 |

OTHER PUBLICATIONS

Electronic Design, "Use Transconductance Amplifiers to Make Programmable Active Filters. The OTAs Offer 10-Octave Tuning Range by Using Predictable $V_{Be}$-Versus-$I_c$ Relationships", Dr. S. Franco, vol. 24, No. 19, pp. 98-101, Sep. 13, 1976.

*Primary Examiner*—Stanley D. Miller
*Assistant Examiner*—B. P. Davis

[57] ABSTRACT

A logarithmic converter circuit comprises a logarithmic transfer function generating device and a transconductance amplifier connected in parallel with that logarithmic transfer function generating device, the transconductance amplifier preferrably having a transconductance in the range of about two micromhos to about twenty millimhos.

23 Claims, 5 Drawing Figures

LOGARITHMIC CONVERTER CIRCUIT ARRANGEMENTS

This invention relates to circuit arrangements, and more particularly to logarithmic converter circuit arrangements.

Logarithmic converter circuits generate an output signal that is a logarithmic function of an input signal. Useful applications of such circuits include instrumentation, analog computational circuitry, and control circuitry. Logarithmic converter circuits frequently use the inherent logarithmic relationship provided by a transfer device such as a silicon junction device, with the output signal being held in logarithmic relationship to the input signal by a high gain operational amplifier that is connected in parallel with the junction device.

A logarithmic converter circuit for instrumentation applications, such as an optical measurement system where a pulsed (as short as a few hundred microseconds duration) hollow cathode lamp is used as the light source and a large area PIN silicon photodiode is used as the optical sensor, desirably has: (1) a reference channel, for example to compensate for changes in light source intensity in an optical measurement instrument; (2) high speed—for example, in response to an incremental signal and reference current step, the output should settle to 0.01% in a few hundred microseconds or less over the entire signal and reference current range of interest; (3) wide dynamic range—the output should hold over a range of signal and reference currents of about 100 picoamperes to about 1 milliampere and with signal and reference sources that have output capacitances ranging from about 30 to about 3000 picofarads and high output resistances (about 100 kilo ohms and above); and (4) temperature stability—for a 1° C. change in ambient temperature, the change in output should correspond to an input current signal change of less than 0.1 millidecade, i.e., 0.025% and hold over an ambient temperature range of 15° C. to 35° C. Such a logarithmic converter should contribute an error of less than 10 microabsorbance units per minute in an optical absorbance rate measurement where the environment of logarithmic converter has a change of 0.1° C. per minute (i.e., 6° C. per hour).

Available logarithmic converter circuits do not meet these requirements as they are much too slow at low input currents—a response time of several hundred milliseconds at 100 picoamperes where a silicon photodiode is used as the signal or reference source; and they lack adequate temperature stability.

In accordance with one aspect of the invention, there is provided a logarithmic converter circuit comprising a logarithmic transfer function generating device such as a semiconductor junction (e.g., a PN junction of a silicon logging transistor) component, and a transconductance amplifier connected in parallel with that logarithmic transfer function generating device, the transconductance amplifier preferrably having a transconductance in the range of about two micromhos to about twenty millimhos. The transconductance amplifier simulates a current source and has a high output impedance—its output resistance being at least three times (and preferrably at least about ten times) the dynamic emitter resistance of the transistor logging component at its operating ($I_{input}$) current level.

A feature of logarithmic converter circuits in accordance with this feature of the invention is that their speed is independent of input current level, the circuit speed being a function of the transconductance amplifier pole; in contrast with prior art logarithmic converter circuits whose speeds change with input current level. In preferrred embodiments, a control network, such as an RC circuit connected to the converter circuit output, is utilized to limit the overall circuit speed to the system speed requirements, thus eliminating excess circuit speeds that increase circuit noise characteristics.

In accordance with another aspect of the invention, there is provided a temperature compensated logarithmic converter circuit that includes a main converter circuit for producing an output signal at an output terminal as a logarithmic function of an input signal, the main converter circuit including a pair of temperature dependent logarithmic transfer function generating devices; and a compensation circuit that includes a pair of logarithmic converter circuits, each of which includes a temperature dependent logarithmic transfer function generating device that is matched with the temperature dependent logarithmic transfer function generating devices of the main converter circuit. Input signals are applied to the two logarithmic converter circuits of the compensating circuit in known ratio and the compensating circuit produces a compensating signal that varies as a function of temperature. That compensating signal is combined with the output signal of the main converter circuit to compensate for temperature dependent changes in the output signal of the main converter circuit.

In a particular embodiment, the system includes a first silicon photodiode photosensor that has a capacitance in excess of 100 picofarads and that applies a data signal to the input of a first logarithmic converter circuit that has a transconductance amplifier with a transconductance of about three millimho. A logarithmic feedback transistor is connected in parallel with the transconductance amplifier. A second logarithmic converter circuit has an input to which a reference signal from a similar silicon photodiode is applied and an output, and that circuit also includes a logarithmic feedback transistor connected in parallel with a transconductance amplifier that also has a transconductance of about three millimho, the two logarithmic feedback transistors being a matched pair. A buffer amplifier is connected between each photodiode and the input to its transconductance amplifier; and an RC speed control network and a high-quality voltage gain amplifier follows each logarithmic converter circuit. The output of the first logarithmic converter circuit is connected to a first input of a differential amplifier, the output of the second logarithmic converter circuit is connected to a second input of the differential amplifier, and a third connection to one of the differential amplifier inputs is from a compensation circuit that produces a temperature dependent compensating signal. That compensation circuit includes two logarithmic converter circuits that have current inputs in decade relationship and each log converter circuit including a temperature dependent logarithmic transfer function generating device (a silicon transistor) in a feedback circuit. The emitters of the two transistors are connected together and the base of one of the transistors is connected to a voltage divider network from which a temperature dependent compensation signal is derived. The temperature dependent compensation signal generated by the compensation circuit is applied to variable output circuitry (a potentiometer or other suitable circuitry) which produces compensation signals over a range that exceeds the signal range of the instrument. A nulling circuit, coupled between the system output and the variable output circuitry, is controlled to adjust the variable output circuitry immediately prior to a measurement by the system, and to select a compensation signal that is applied to the differential amplifier.

Circuitry in accordance with the invention provide improved logarithmic converter systems that have features of wide dynamic range, high-speeds and speeds independent of input current level, effective temperature compensation; and such systems are particularly useful in instrumentation applications for measuring small magnitude rate signals, for example.

Other features and advantages of the invention will be seen as the following description of a particular embodiment progresses, in conjunction with the drawings, in which.

DESCRIPTION OF PARTICULAR EMBODIMENT

Figure 1:
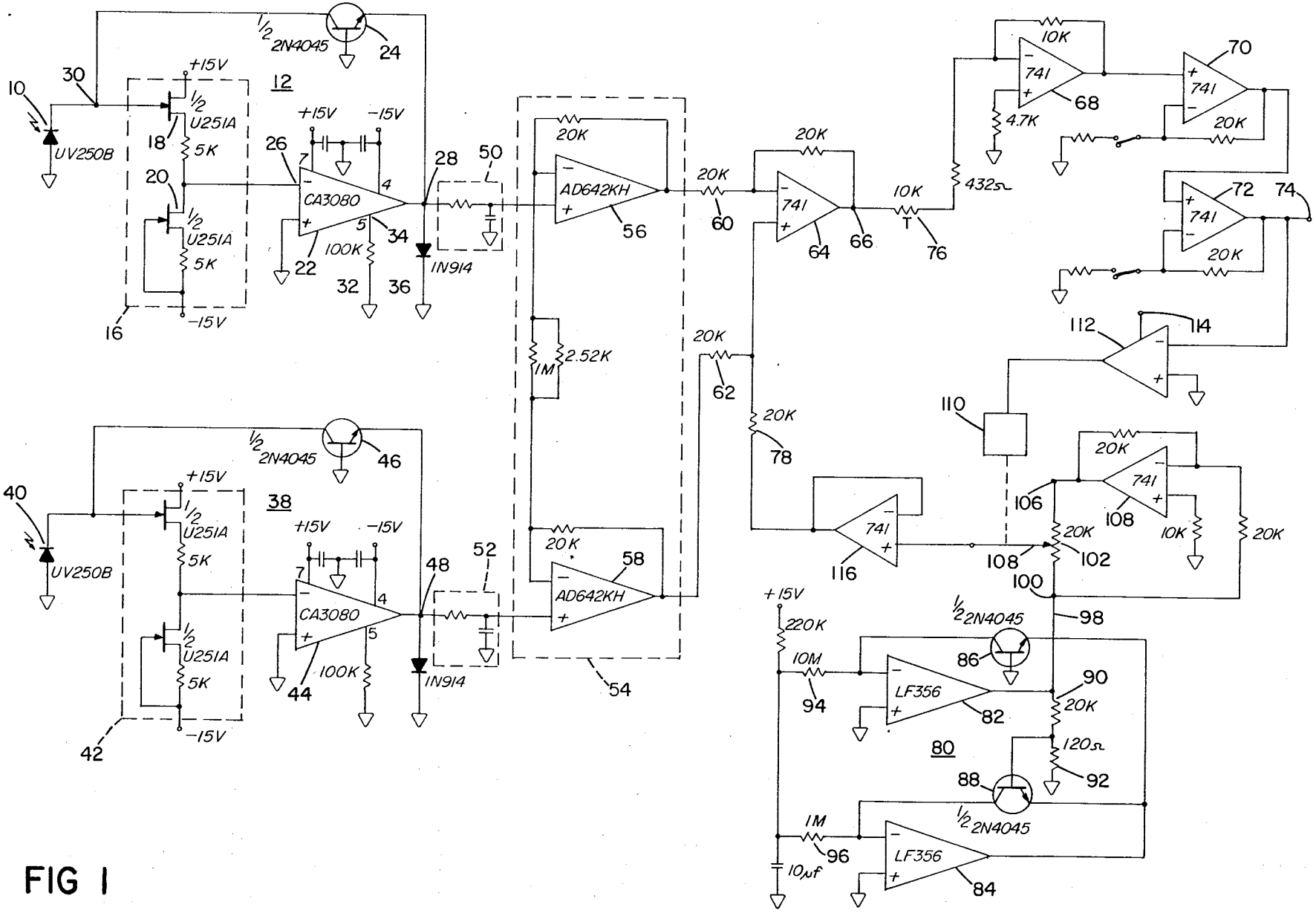
FIG. 1 is a schematic diagram of logarithmic converter circuitry in accordance with the invention.

The circuitry shown in FIG. 1 includes sensor 10—a silicon photodiode that has a capacitance of about 200 picofarads and a shunt resistance of about 100 megohms. In an optical measurement system in which a pulsed hollow cathode lamp is used as the light source, output current from sensor 10 ranges from about 100 picoamperes up to about one milliampere. That sensor output current is applied to channel 12 which includes unity gain buffer amplifier 16 that includes field effect transistors 18, 20, transconductance amplifier 22 and silicon logging (feedback) transistor 24. The output signal from amplifier 16 is applied to inverting terminal 26 of transconductance amplifier 22. Log transistor 24 is connected in the feedback loop between output 28 of amplifier 22 and summing point 30. Resistor 32 is connected to amplifier bias input 34, setting the forward transconductance of amplifier 22 to a value of about three millimhos, and clamping diode 36 is connected to output 28.

Figure 2:
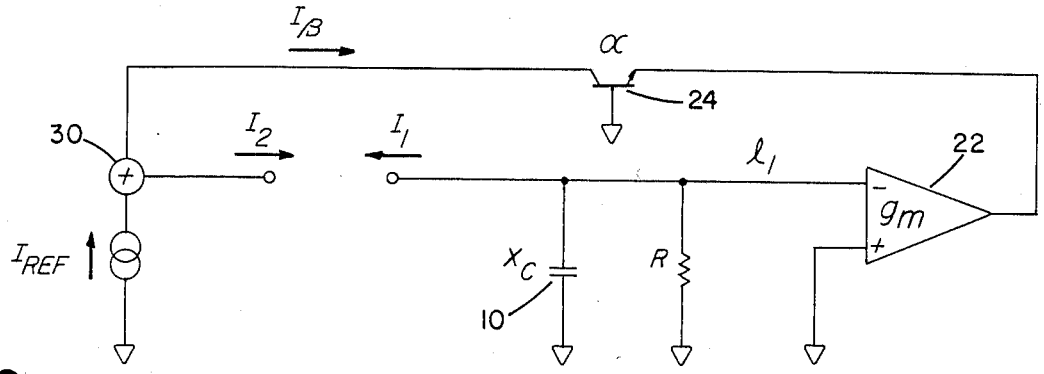
FIG. 2 is a schematic diagram of a logarithmic converter circuit of the type employed in the circuitry of FIG. 1.

With reference to FIG. 2, the open loop gain of this logarithmic converter stage may be derived as follows:

$$\Delta I_2 = \alpha g_m \Delta I_1 = \alpha g_m \Delta I_1 (X_c // R)$$

$$\text{Loop gain} = \frac{\Delta I_2}{\Delta I_1} = \alpha g_m \frac{R}{1 + j\omega RC}$$

Figure 3:
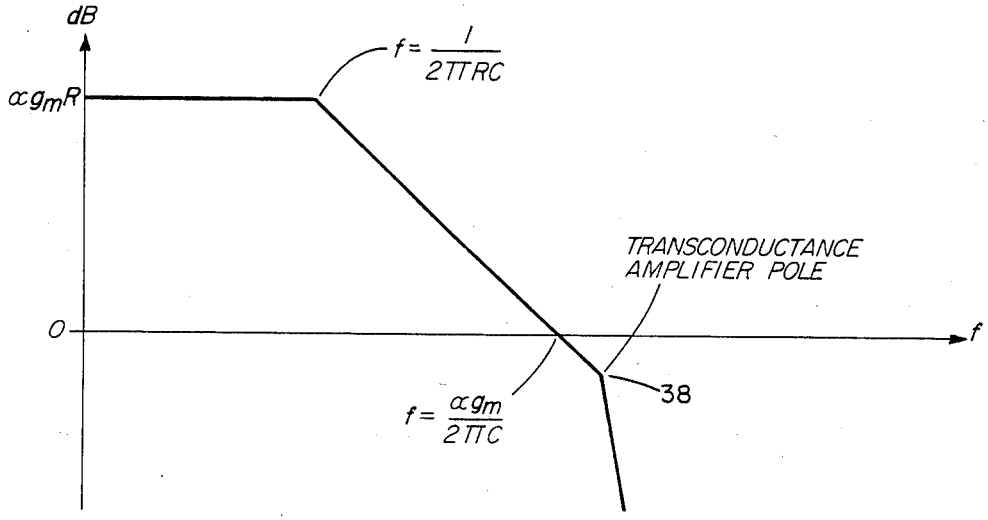
FIG. 3 is a diagram of circuit stability characteristics of the circuit shown in FIG. 2.

The open loop gain amplitude as a function of frequency is shown in FIG. 3. The loop gain is stable as long as the transconductance amplifier pole 38 lies below the zero db gain axis. The unity open loop gain frequency is equal to $\alpha g_m/2\pi C$. For the output to settle to 0.01% in 200 microseconds in response to an incremental step input current, the transconductance of amplifier 22 is adjusted so that $\alpha g_m/2\pi C$. is greater than approximately 200 kilohertz.

Reference channel 38 is connected to a reference silicon photodiode 40 and includes a similar logarithmic converter circuit with buffer amplifier 42, transconductance amplifier 44 and feedback transistor 46 that is matched with feedback transistor 24 of signal channel 12.

The output 28 of signal channel 12 (a voltage that is a logarithmic function of the input current) and the similar voltage output 48 of reference channel 38 are applied through RC circuits 50, 52 to differential buffer amplifier 54 that includes operational amplifiers stages 56, 58 and provides amplified voltage outputs (an amplification factor of about 16.9) for application through resistors 60, 62 respectively to low input impedance, unity gain differential amplifier 64. The two RC circuits 50, 52 are tailored to adjust the overall circuit speed to the speed requirements of the instrumentation system so that excess circuit speeds which increase noise characteristics are avoided. The resulting signal from differential amplifier 64 (the amplified difference between the signals from channels 12 and 38) at terminal 66 is applied to unity gain inverter 68 and is then passed through gain programmable amplifier stages 70, 72 to output terminal 74.

A temperature compensation signal is provided by dual channel logarithmic converter circuit 80 and applied through resistor 78 to differential amplifier 64. Circuit 80 has voltage amplifiers 82, 84 and matched feedback logging transistors 86, 88 that have their emitters connected together. The base electrode of log transistor 86 is grounded and the base electrode of log transistor 88 is connected to the junction between resistors 90 and 92. The input resistors 94, 96 of voltage amplifiers 82, 84 respectively are in decade ratio so that the temperature dependent characteristic base-emitter voltage of silicon transistor 88 (59.2 millivolts/decade at 25° C.) is applied to the voltage divider junction between resistors 90 and 92, and circuit 80 has an output of about plus ten volts on line 98, which output is applied to terminal 100 of voltage selection potentiometer 102. Inverting amplifier 104 applies the inverse voltage (e.g., minus ten volts) to potentiometer terminal 106. Thus potentiometer 102 provides a range of output voltages, one of which is selected by adjustable potentiometer tap 108 which is moved by drive 110 that is coupled to zeroing amplifier 112. The output voltage from tap 108 is applied through unity gain buffer amplifier 116 as a temperature compensation signal to resistor 78 of differential amplifier 64 for subtraction from the difference between the signals produced from the signal and reference channels 12 and 38. Amplifier 112 has an input from output terminal 74, and in response to an enable signal at terminal 114, operates drive 110 to move tap 108 to zero the output at terminal 74.

The voltage applied at terminal 100 of potentiometer 102 is a direct function of the difference in the voltages of the temperature dependent silicon logging transistors 86, 88. To maximize the temperature independence of the voltage at the output 66 of differential amplifier 64, the log transistor pair 86, 88 of circuit 80, the signal log transistor 24, and the reference log transistor 46 should be matched and in close thermal proximity to one another so that changes in ambient temperature produce the same temperature changes in the matched logging transistor pairs.

Figure 4:
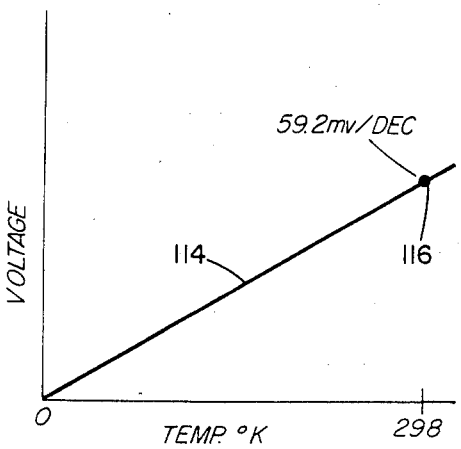
FIG. 4 is a diagram indicating temperature dependent characteristics of a silicon transistor pair.
Figure 5:
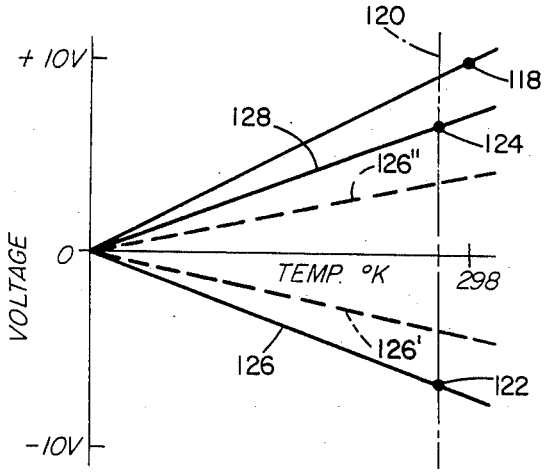
FIG. 5 is a diagram indicating temperature compensation aspects of the circuitry shown in FIG. 1.

The temperature sensitivity characteristic of logging transistor pair 24, 46 is a linear function of temperature as illustrated by curve 114 of FIG. 4. At 298° K, for example, the difference in the base-emitter voltages (point 116) changes about 59 mv for a one decade change in the relative input currents. The voltage generated by circuit 80 at terminal 100 has the same temperature sensitivity characteristic, the value of resistor 92 being selected so that at 25° C., that temperature dependent output voltage (point 118 in FIG. 5) has a value of about ten volts. At any particular ambient temperature, for example 20° C. 293° K—line 120 in FIG. 5), potentiometer 102 provides a range of voltages, any one of which may be selected by tap 108. Due to the zeroing action of amplifier 112 and drive 110, the voltage 122 selected by tap 108 is equal and opposite to the differential output voltage 124 of amplifier 54. The voltage 122 is temperature dependent and varies linearly along line 126, while the equal and opposite output voltage 124 of amplifier 54 is similarly temperatrure dependent and varies linearly along line 128. All other voltages available for selection by tap 108 are similarly temperature dependent as indicated by lines 126' and 126''.

Differential amplifier 64 provides a one volt per decade output at 25° C. at its output terminal 66. Immediately before a data measurement, the zeroing circuitry, in response to a command on line 114, operates drive 110 to move tap 108 and select a voltage 122 that compensates for the termperature dependent offset voltage then being generated by the signal and reference channels 12 and 38 (the output voltage of amplifier 54). Supplemental temperature compensation is provided by temperature compensation resistor 76 that is connected between output 66 and unity gain inverter 68.

The circuitry provides a wide dynamic range, high-speed, temperature compensated logarithmic converter circuitry that is particularly useful with dual channnel (signal and reference) instrumentation that employs low input current sensors. While a particular embodiment of the invention has been shown and described, various modifications will be apparent to those skilled in the art. For example, other zeroing electronics may be substituted to potentiometer 102 in an automated instrument. Therefore it is not intended that the invention be limited to the disclosed embodiment or to details thereof, and departures may be made therefrom within the spirit and scope of the invention.

What is claimed is:

1. A logarithmic converter circuit comprising an input to which a data signal may be applied, a logarithmic transfer function generating device connected to said input, a transconductance amplifier connected in parallel with said logarithmic transfer function generating device, and an output, said circuit generating a signal at said output that is a logarithmic function of the data signal applied to said input.

2. The circuit of claim 1 and further including a control network connected to the converter circuit output for limiting the overall circuit speed to the speed requirements of the system.

3. The circuit of claim 2 wherein said control network is an RC circuit.

4. The circuit of claim 1 wherein said logarithmic transfer function generating device includes a semiconductor junction.

5. The circuit of claim 4 wherein said logarithmic transfer function generating device is a transistor.

6. A logarithmic converter circuit comprising an input to which a data signal may be applied, a logarithmic transfer function generating transistor connected to said input, a transconductance amplifier connected in parallel with said transistor, the output resistance of said transconductance amplifier being at least three times the dynamic emitter resistance of said transistor at its operating ($I_{input}$) current level, and an output, said circuit generating a signal at said output that is a logarithmic function of the data signal applied to said input.

7. The circuit of either claim 1 or 6 wherein said transconductance amplifier has a transconductance in the range of about two micromhos to about twenty millimhos.

8. The circuit of claim 7 and further including a buffer amplifier connected in circuit between said data signal input and said transconductance amplifier, and a voltage gain amplifier connected to said data signal output.

9. A logarithmic converter circuit comprising an input to which a data signal may be applied, a logarithmic transfer function generating device connected to said input, a transconductance amplifier connected in parallel with said logarithmic transfer function generating device, and an output, said circuit generating a signal at said output that is a logarithmic function of the data signal applied to said input, an input to which a reference signal is applied, a second logarithmic transfer function generating device connected to said reference signal input, a second transconductance amplifier connected in parallel with said second logarithmic transfer function generating device, and a reference output, said circuit generating a signal at said reference output that is a logarithmic function of the reference signal applied to said reference signal input, the two said logarithmic transfer function generating devices being a matched pair, differential amplifier means having first and second inputs and an output, a first connection between said first input of said differential amplifier and said data signal output, and a second connection between said second input of said differential amplifier and said reference signal output.

10. A temperature compensated logarithmic converter circuit comprising a main converter circuit for producing an output signal at an output terminal as a logarithmic function of an input signal, said main converter circuit including a pair of temperature dependent logarithmic transfer function generating devices; and a compensation circuit that includes a pair of logarithmic converter circuits, each said logarithmic converter circuit including a temperature dependent logarithmic transfer function generating device that is matched with the temperature dependent logarithmic transfer function generating devices of said main converter circuit, means to apply input signals to said pair of logarithmic converter circuits of said compensation circuit in known ratio, said compensation circuit producing a compensating signal that varies as a function of temperature, and means to combine said compensating signal with the output signal from said main converter circuit to compensate for temperature dependent changes in the output signal of said main converter circuit.

11. The circuit of claim 10 and further including variable output circuitry for producing output signals over a range that exceeds the signal range of said main converter circuit, means for applying said compensation signal to said variable output circuitry, and a nulling circuit coupled between the output of said main converter circuit and said variable output circuitry for adjusting said variable output circuitry

12. The circuit of claim 11 wherein said main converter circuit includes a silicon photodiode photosensor that has a capacitance in excess of about one hundred picofarads and that applies a data signal to the input of main converter circuit, a second logarithmic converter circuit that has an input to which a reference signal from a similar silicon photodiode is applied, a reference output, a differential amplifier, means to apply the data and reference output signals to the inputs of said differential amplifier, and means to apply said compensating signal to one of the inputs of said differential amplifier.

13. The circuit of claim 12 and further including RC circuit control networks connected between the data and reference outputs of said logirithmic converter circuits and the inputs of said differential amplifier for limiting the overall system speed to the speed requirements of the system.

14. The circuit of claim 11 wherein said main converter circuit includes a logarithmic transfer function generating device connected to said input, and a transconductance amplifier connected in parallel with said logarithmic transfer function generating device.

15. The circuit of claim 14 wherein said logarithmic transfer function generating device includes a semiconductor junction.

16. The circuit of claim 15 and further including a control network connected to the converter circuit output for limiting the overall circuit speed to the speed requirements of the system.

17. The circuit of claim 16 wherein said logarithmic transfer function generating device is a silicon transistor.

18. The circuit of claim 17 wherein the output resistance of said transconductance amplifier is at least ten times the dynamic emitter resistance of said transistor at its operating ($I_{input}$) current level.

19. The circuit of claim 18 wherein said transconductance amplifier has a transconductance in the range of about two micromhos to about twenty millimhos.

20. The circuit of either claim 10 or 19 wherein each said temperature dependent logarithmic transfer function generating device of said compensation circuit is a silicon transistor, the emitters of said transistors are connected together, and the base of one of said transistors is connected to a voltage divider network, said input signals are applied to said pair of logarithmic converter circuits of said compensation circuit in decade ratio, and said voltage divider network produces said compensating signal.

21. The circuit of claim 20 wherein said variable output circuitry includes a potentiometer, said means for applying said compensation signal to said variable output circuitry includes an inverter circuit, and said nulling circuit is arranged for adjusting the tap of said potentiometer.

22. The circuit of either claim 1 or 19 and further including a photosensor for applying said data signal to said logarithmic converter circuit input, said photosensor having a capacitance in excess of about one hundred picofarads.

23. The circuit of claim 22 and further including a control network connected to the converter circuit output for limiting the overall circuit speed to the speed requirements of the system.

* * * * *